US011774178B2

(12) United States Patent
Taras et al.

(10) Patent No.: US 11,774,178 B2
(45) Date of Patent: Oct. 3, 2023

(54) HEAT EXCHANGER FOR A HEATING, VENTILATION, AND AIR-CONDITIONING SYSTEM

(71) Applicant: Goodman Global Group, Inc, Waller, TX (US)

(72) Inventors: Michael F. Taras, The Woodlands, TX (US); David Boyea, Houston, TX (US); Terry Jewell, Cypress, TX (US); Auston Green, Cypress, TX (US); Ying Gong, Fulsher, TX (US); Aaron James, Cypress, TX (US)

(73) Assignee: Goodman Global Group, Inc., Waller, TX (US)

( * ) Notice: Subject to any disclaimer, the term of this patent is extended or adjusted under 35 U.S.C. 154(b) by 0 days.

(21) Appl. No.: 17/136,889

(22) Filed: Dec. 29, 2020

(65) Prior Publication Data

US 2022/0205725 A1 Jun. 30, 2022

(51) Int. Cl.
*F28D 1/053* (2006.01)
*F28F 9/02* (2006.01)
(Continued)

(52) U.S. Cl.
CPC ..... *F28D 1/05391* (2013.01); *F25B 39/028* (2013.01); *F28F 9/0204* (2013.01); *F28D 2021/0071* (2013.01)

(58) Field of Classification Search
CPC ..... F28D 1/05391; F28D 2021/0071; F25B 39/028; F28F 9/0204
(Continued)

(56) References Cited

U.S. PATENT DOCUMENTS 5,927,392 A * 7/1999 Youn ..... F28F 1/325 165/151
6,026,804 A * 2/2000 Schardt ..... F28F 27/02 165/173

(Continued)

FOREIGN PATENT DOCUMENTS

CN 110595114 A 12/2019
JP 2000274789 A 10/2000
JP 2011145010 A 7/2011

OTHER PUBLICATIONS

International Search Report and Written Opinion dated Mar. 23, 2022 for PCT Application No. PCT/US2021/072724 filed Dec. 3, 2021.

*Primary Examiner* — Tho V Duong
*Assistant Examiner* — Raheena R Malik
(74) *Attorney, Agent, or Firm* — K&L Gates LLP

(57) ABSTRACT

An HVAC system for use with a first refrigerant and a second refrigerant. The HVAC system may include a first refrigerant circuit for use with the first refrigerant, a second refrigerant circuit for use with the second refrigerant, and a heat exchanger. The first refrigerant circuit and the second refrigerant circuit may each include may include a compressor, an expansion device, and an evaporator. The compressor may include a first upper section, a first lower section, a second upper section in fluid communication with the first lower section, and a second lower section in fluid communication with the first upper section. The first upper section, the first lower section, the second upper section, and the second lower section may be arranged such that the first refrigerant and the second refrigerant both flow through a majority of a face area of condenser while remaining in two different circuits.

20 Claims, 7 Drawing Sheets

(51) Int. Cl.
*F25B 39/02* (2006.01)
*F28D 21/00* (2006.01)

(58) Field of Classification Search
USPC ..... 165/173
See application file for complete search history.

(56) References Cited

U.S. PATENT DOCUMENTS 6,182,744 B1 * 2/2001 Nakamura ..... F28D 1/0417 62/509
6,701,723 B1 * 3/2004 Dobmeier ..... F24F 11/0008 62/90
6,705,093 B1 * 3/2004 Taras ..... F24F 3/153 62/90
6,941,770 B1 * 9/2005 Taras ..... F24F 3/153 62/196.4
7,143,822 B2 * 12/2006 Wisniewski ..... F28D 1/05366 165/173
7,178,579 B2 * 2/2007 Kolb ..... F02B 29/0475 165/41
7,290,593 B2 * 11/2007 Kolb ..... F02B 29/0475 165/41
10,989,479 B2 * 4/2021 Dziubinschi ..... B60H 1/00335
2001/0022220 A1 * 9/2001 Ozaki ..... F28D 1/0435 165/135
2005/0016716 A1 * 1/2005 Hu ..... F28D 1/0443 165/110
2009/0211743 A1 * 8/2009 Schrader ..... F28F 9/0221 165/173
2011/0240275 A1 * 10/2011 Piggott ..... F28F 9/02 165/173
2013/0292098 A1 * 11/2013 Jindou ..... F28F 1/022 165/151
2016/0116230 A1 * 4/2016 Taras ..... B23P 15/26 165/173
2017/0328637 A1 * 11/2017 Parola ..... F28D 1/0443
2018/0299171 A1 * 10/2018 Olsen ..... F28F 9/0202
2019/0049194 A1 * 2/2019 Yanik ..... F28F 1/32
2019/0170412 A1 6/2019 Yanachi et al.
2020/0033064 A1 * 1/2020 Dziubinschi ..... F28D 1/05391
2020/0191490 A1 * 6/2020 Jin ..... F28F 9/0278
2021/0003353 A1 * 1/2021 Akaiwa ..... F28F 9/02
2021/0048251 A1 * 2/2021 Sathyamurthi ..... F28D 15/043
2021/0215400 A1 * 7/2021 Taras ..... F25B 30/02
2021/0222893 A1 * 7/2021 Matsui ..... F28D 1/0452
2021/0262461 A1 * 8/2021 Taras ..... F04B 25/00
2021/0302073 A1 * 9/2021 Taras ..... F25B 49/02
2021/0302089 A1 * 9/2021 Taras ..... F25B 49/022
2021/0364208 A1 * 11/2021 Taras ..... F25B 39/00
2021/0381699 A1 * 12/2021 Taras ..... F24F 1/18

* cited by examiner 100
120
106

136
104
122
INDOOR HEAT EXCHANGER
102
GAS FURNACE
118
116
114
110
BLOWER
114
110
124
C.S.
FLOW CONTROL
112
112
COMPRESSOR
126
ACCUMULATOR
RECEIVER
132
130
128
134

HEAT EXCHANGER FOR A HEATING, VENTILATION, AND AIR-CONDITIONING SYSTEM

BACKGROUND

This section is intended to provide relevant background information to facilitate a better understanding of the various aspects of the described embodiments. Accordingly, these statements are to be read in this light and not as admissions of prior art.

In general, heating, ventilation, and air-conditioning ("HVAC") systems circulate an indoor space's air over low-temperature (for cooling) or high-temperature (for heating) sources, thereby adjusting an indoor space's ambient air temperature. HVAC systems generate these low- and high-temperature sources by, among other techniques, taking advantage of a well-known physical principle: a fluid transitioning from gas to liquid releases heat, while a fluid transitioning from liquid to gas absorbs heat.

Within a typical HVAC system, a fluid refrigerant circulates through a closed loop of tubing that uses a compressor and flow-control devices to manipulate the refrigerant's flow and pressure, causing the refrigerant to cycle between the liquid and gas phases. Generally, these phase transitions occur within the HVAC system heat exchangers, which are part of the closed loop and designed to transfer heat between the circulating refrigerant and flowing ambient air. As would be expected, the heat exchanger providing heating or cooling to the climate-controlled space or structure is described adjectivally as being "indoors," and the heat exchanger transferring heat with the surrounding outdoor environment is described as being "outdoors."

The refrigerant circulating between the indoor and outdoor heat exchangers—transitioning between phases along the way—absorbs heat from one location and releases it to the other. Those in the HVAC industry describe this cycle of absorbing and releasing heat as "pumping." To cool the climate-controlled indoor space, heat is "pumped" from the indoor side to the outdoor side, and the indoor space is heated by doing the opposite, pumping heat from the outdoors to the indoors.

BRIEF DESCRIPTION OF THE DRAWINGS

Embodiments of the HVAC system are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes heat exchangers for use with an HVAC system. The heat exchangers may be round tube and plate fin ("RTPF") heat exchangers that include a plurality of tubes that pass from one side of the head exchanger to the other through a slab made of fins. The tubes in turn may be connected to a plurality of circuits providing parallel paths for the fluid flowing within. The heat exchangers may also be microchannel heat exchangers that include a plurality of tubes that each include a number of microchannels for flowing refrigerant from one side of the heat exchanger to the other, or one "pass" across the heat exchanger. The fluid may make two or more passes across the heat exchanger, with each successive pass being a different stage. One or more tubes that flow fluid in a given direction across the heat exchanger at the same stage in the flow circuit are grouped together into a section and multiple sections are fluidly connected via the headers or manifolds. The tubes may also be bonded to the fins therebetween.

Further, in the microchannel heat exchanger, the adjacent sections of tubes are separated, as discussed in more detail below. The separation between the adjacent sections of tubes is sufficient enough to reduce the cross transfer of heat between the sections, improving the performance of the microchannel heat exchanger and reducing the size of the microchannel heat exchanger when compared to a heat exchanger without a separation. The separation also reduces the thermal stress on the joints between the tubes and the header since there is a smaller temperature differential between the tube and the header.

In either case, the heat exchanger may include multiple refrigeration circuits passing therethrough. As will be explained in further detail below, by arranging the circuits such that each circuit utilizes the entire face area of the heat exchanger, the overall system efficiency is increased while operating at a part load condition. Further, this arrangement may allow for a reduction in the overall size of the heat exchanger since, under a part load condition, the operational circuit can utilize the entire face area of the heat exchanger.

Figure 1:
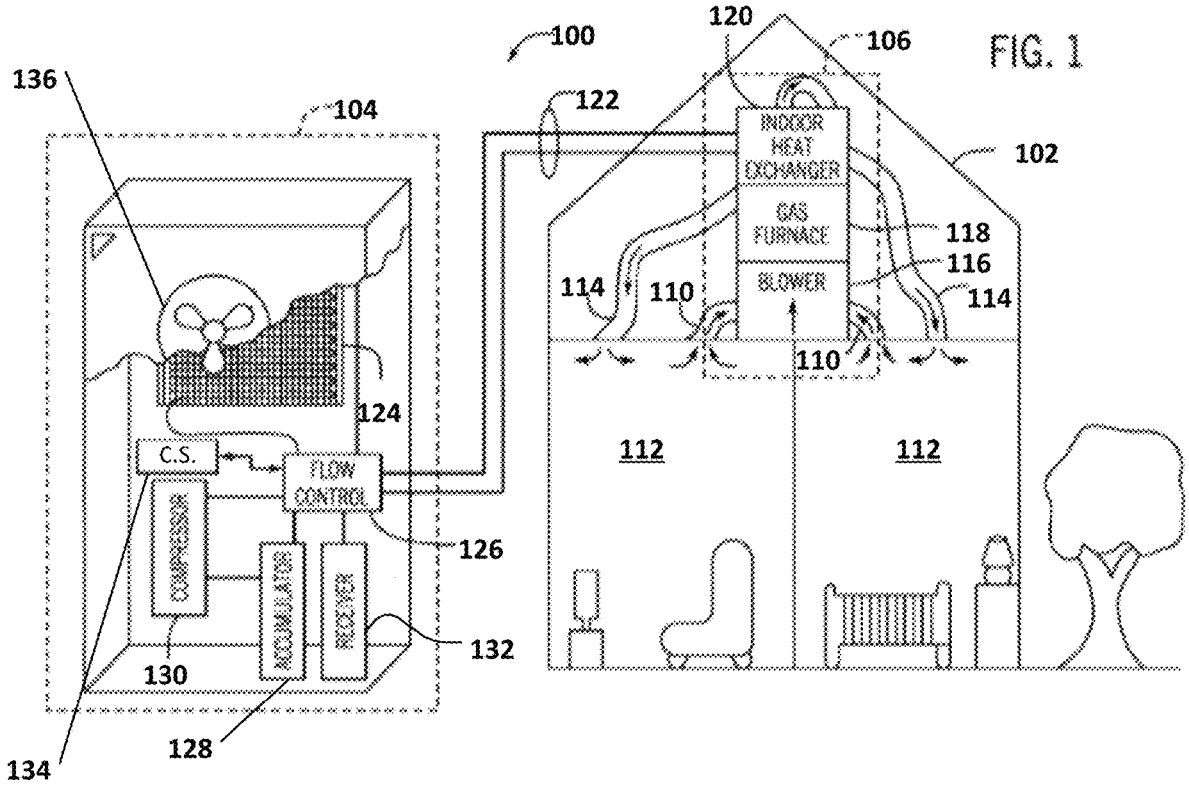
FIG. 1 is a block diagram of an HVAC system, according to one or more embodiments.

Turning now to the figures, FIG. 1 shows an HVAC system 100 in accordance with one embodiment. As depicted, the HVAC system 100 provides heating and cooling for a residential structure 102. However, the concepts disclosed herein are applicable to numerous of heating and cooling situations, which include residential, industrial, and commercial settings.

The described HVAC system 100 is divided into two primary portions: (1) the outdoor unit 104, which mainly comprises components for transferring heat with the environment outside the structure 102; and (2) the indoor unit 106, which mainly comprises components for transferring heat with the air inside the structure 102. To heat or cool the illustrated structure 102, the indoor unit 106 draws ambient indoor air via return ducts 110, passes that air over one or more heating/cooling elements (i.e., sources of heating or cooling), and then routes that conditioned air, whether heated or cooled, back to the various climate-controlled spaces 112 through the supply ducts or ductworks 114— which are relatively large conduits that may be rigid or flexible. A blower 116 provides the motivational force to circulate the ambient air through the return ducts 110 and the supply ducts 114. Additionally, although a split system is shown in FIG. 1, the disclosed embodiments can be equally applied to the packaged or other types of the HVAC system configurations.

As shown, the HVAC system 100 is a "dual-fuel" system that has multiple heating elements, such as an electric heating element or a gas furnace 118. The gas furnace 118 located downstream (in relation to airflow) of the blower 116 combusts natural gas to produce heat in furnace tubes (not shown) that coil through the gas furnace 118. These furnace tubes act as a heating element for the ambient indoor air being pushed out of the blower 116, over the furnace tubes, and into the supply ducts 114. However, the gas furnace 118 is generally operated when robust heating is desired. During conventional heating and cooling operations, air from the blower 116 is routed over an indoor heat exchanger 120 and into the supply ducts 114. The blower 116, the gas furnace 118, and the indoor heat exchanger 120 may be packaged as an integrated air handler unit, or those components may be modular. In other embodiments, the positions of the gas furnace 118, the indoor heat exchanger 120, and the blower 116 can be reversed or rearranged.

The indoor heat exchanger 120 acts as a heating or cooling means that adds or removes heat from the structure, respectively, by manipulating the pressure and flow of refrigerant circulating within and between the indoor and outdoor units via refrigerant lines 122. Alternatively, the refrigerant could be circulated to only cool (i.e., extract heat from) the structure, with heating provided independently by another source, such as, but not limited to, the gas furnace 118. There may also be no heating of any kind. HVAC systems 100 that use refrigerant to both heat and cool the structure 102 are often described as heat pumps, while HVAC systems 100 that use refrigerant only for cooling are commonly described as air conditioners.

Whatever the state of the indoor heat exchanger 120 (i.e., absorbing or releasing heat), the outdoor heat exchanger 124 is in the opposite state. More specifically, if heating is desired, the illustrated indoor heat exchanger 120 acts as a condenser, aiding transition of the refrigerant from a high-pressure gas to a high-pressure liquid and releasing heat in the process. The outdoor heat exchanger 124 acts as an evaporator, aiding transition of the refrigerant from a low-pressure liquid to a low-pressure gas, thereby absorbing heat from the outdoor environment. If cooling is desired, the outdoor unit 104 has flow control devices 126 that reverse the flow of the refrigerant, allowing the outdoor heat exchanger 124 to act as a condenser and allowing the indoor heat exchanger 120 to act as an evaporator. The flow control devices 126 may also act as an expander to reduce the pressure of the refrigerant flowing therethrough. In other embodiments, the expander may be a separate device located in either the outdoor unit 104 or the indoor unit 106. To facilitate the exchange of heat between the ambient indoor air and the outdoor environment in the described HVAC system 100, the respective heat exchangers 120, 124 have tubing that winds or coils through heat-exchange surfaces, to increase the surface area of contact between the tubing and the surrounding air or environment.

The illustrated outdoor unit 104 may also include an accumulator 128 that helps prevent liquid refrigerant from reaching the inlet of a compressor 130. The outdoor unit 104 may include a receiver 132 that helps to maintain sufficient refrigerant charge distribution in the HVAC system 100. The size of these components is often defined by the amount of refrigerant employed by the HVAC system 100.

The compressor 130 receives low-pressure gas refrigerant from either the indoor heat exchanger 120 if cooling is desired or from the outdoor heat exchanger 124 if heating is desired. The compressor 130 then compresses the gas refrigerant to a higher pressure based on a compressor volume ratio, namely the ratio of a discharge volume, the volume of gas outputted from the compressor 130 once compressed, to a suction volume, the volume of gas inputted into the compressor 130 before compression. In the illustrated embodiment, the compressor is a multi-stage compressor 130 that can transition between at least two volume ratios depending on whether heating or cooling is desired. In other embodiments, the HVAC system 100 may be configured to only cool or only heat, and the compressor 130 may be a single-stage compressor having only a single volume ratio.

The compressor 130 receives electrical power from a control system 134 that may include an inverter system, as described in more detail below with reference to FIG. 2, which converts the AC power received by the HVAC system 100 to DC power for use by the compressor 130. The control system 134 controls the speed of the compressor 130, as well as the switching between compressor stages for multi-stage compressors, based on the required heating or cooling that must be provided by the HVAC system, i.e., the load on the HVAC system 100. In some embodiments, the control system may also control the speed of a fan 136 that blows air across the heat exchanger 124.

Figure 2:
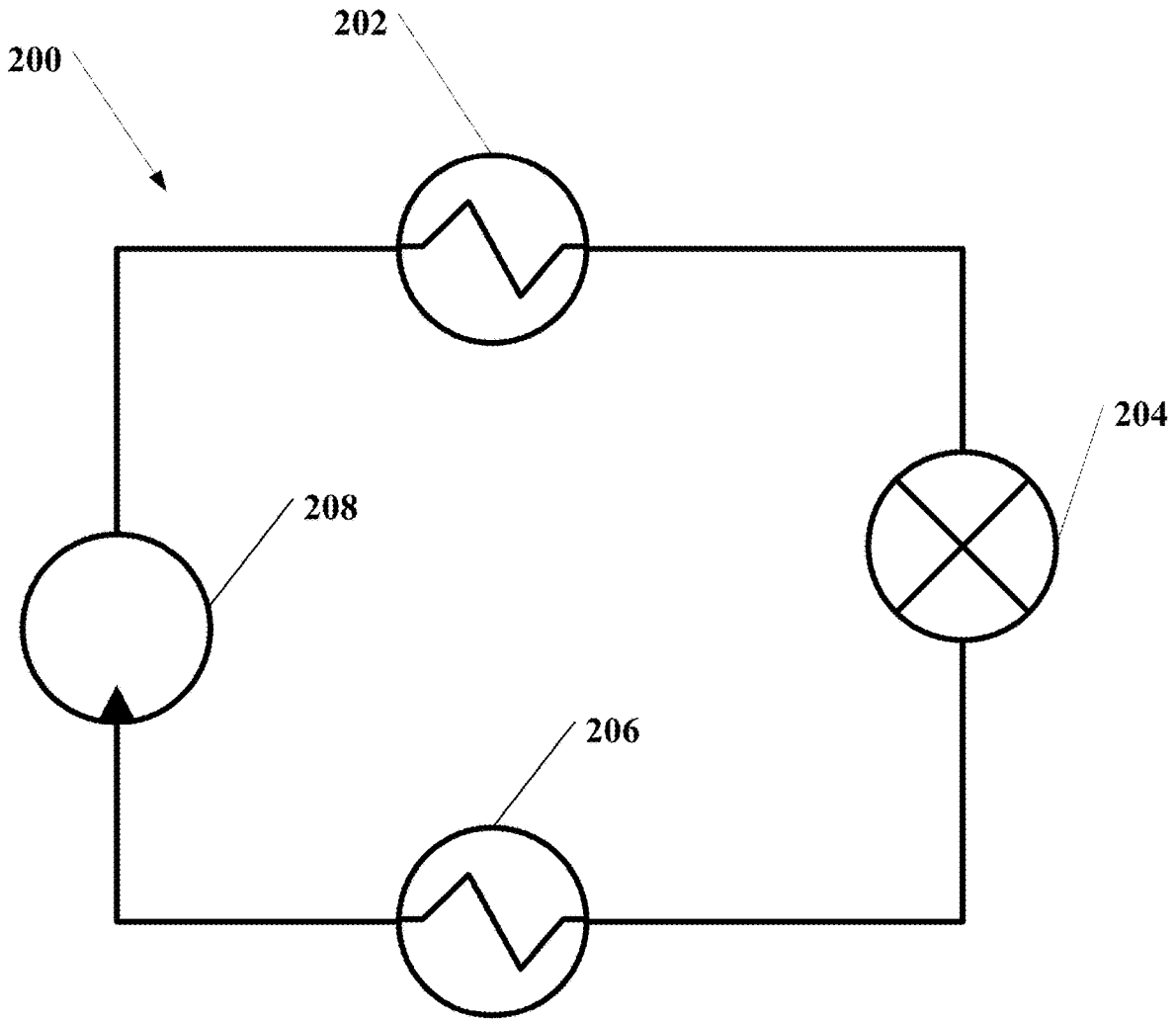
FIG. 2 is a block diagram of an HVAC system 200, according to one or more embodiments.

Referring now to FIG. 2, FIG. 2 shows a block diagram of an HVAC system 200. The HVAC system 200 includes a first heat exchanger 202, an expansion device 204, a second heat exchanger 206, and a compressor 208. Additionally, the heat exchangers 202, 206 may be either indoor or outdoor heat exchangers, depending on the configuration of the HVAC system 200. The HVAC system 200 may also include the equipment shown in FIG. 1 and function as discussed above with reference to FIG. 1. Accordingly, the function of first heat exchanger 202, the expansion device 204, the second heat exchanger 206, and the compressor 208 will not be discussed in detail except as necessary for the understanding of the HVAC system 200 shown in FIG. 2.

As shown in FIG. 2, high-pressure refrigerant flows from the compressor 208 to the first heat exchanger 202, where it is condensed. The high-pressure liquid refrigerant then flows to the expansion device 204, where it is expanded to low-pressure refrigerant. The low-pressure refrigerant is then evaporated in the second heat exchanger 206 and the low-pressure vapor flows into the compressor 208 as a vapor, to begin the cycle again.

Figure 3:
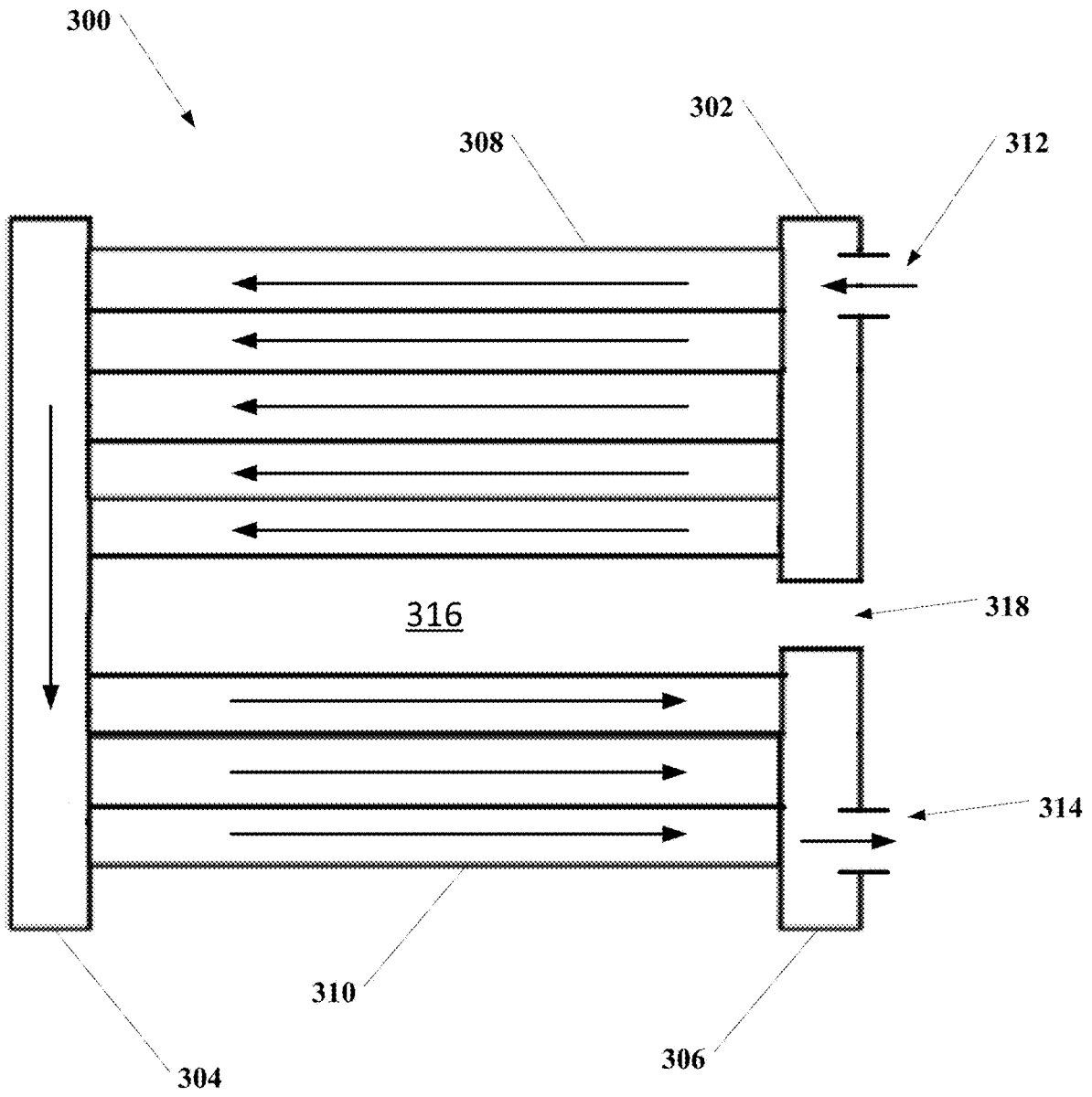
FIG. 3 is a block diagram of a heat exchanger, according to one or more embodiments.

Referring now to FIG. 3, FIG. 3 is a block diagram of a front view of a two-pass microchannel heat exchanger 300 that can be used in an HVAC system, as described above. As explained above, a refrigerant pass is one passage of refrigerant from one header 302, 304 at one end of the heat exchanger 300 to the opposing header 304, 306 at the opposing end of the heat exchanger 300. For each pass, refrigerant flows through a section 308, 310 of a plurality of tubes that carry the refrigerant from one end of the heat exchanger 300 to an opposing end of the heat exchanger 300 for a given stage of the flow through the heat exchanger 300.

Figure 4:
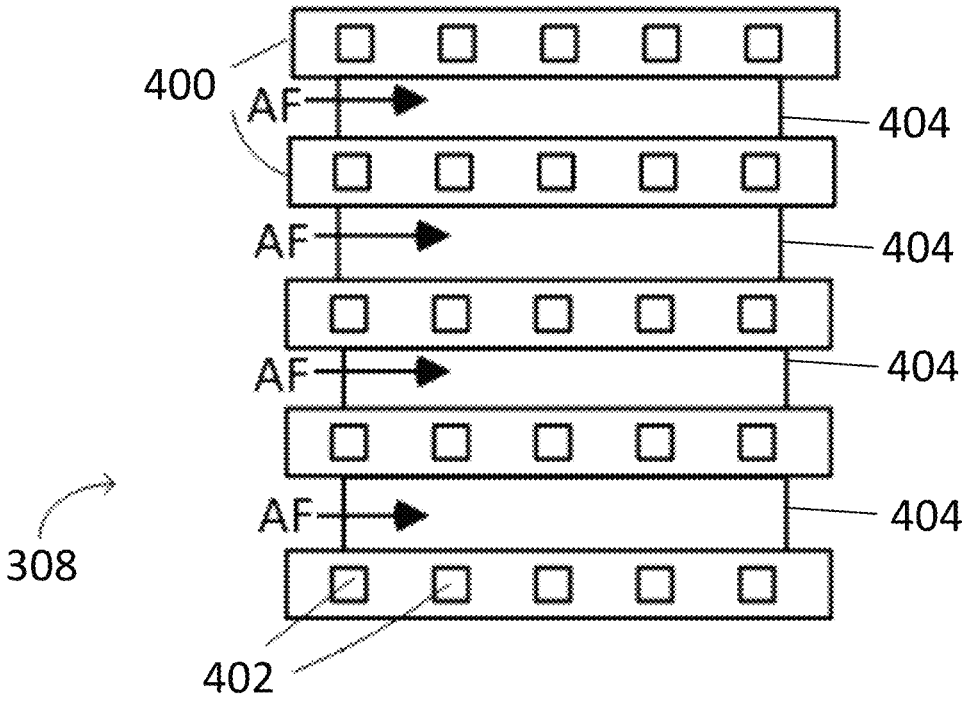
FIG. 4 is a block diagram of a heat exchanger, according to one or more embodiments.

Referring now to FIGS. 3 and 4, FIG. 4 is an expanded block diagram of a cross sectional view of heat exchanger section 308 shown in FIG. 3 Heat exchanger section 308 includes a plurality of tubes 400. Tubes 400 may be tubes known as flat tubes that are wider than high. Each tube 400 includes a plurality of microchannels 402 for carrying refrigerant. Tubes 400 are stacked, thus defining a size or volume of heat exchanger section 308 along the refrigerant flow direction. It will be understood that while tubes are shown "horizontally" stacked in FIG. 4, a heat exchanger may include tubes that are "vertically" stacked. A plurality of fins 404 are arranged between tubes 400 to aid in heat transfer from the microchannels. Heat exchanger section 308 in operation receives airflow AF across the fins between the tubes and exchanges heat between the airflow and the refrigerant flow. Heat exchanger section 310 is composed likewise of tubes and fins (not shown).

Referring back to FIG. 3, headers 302 and 304 are in fluid communication with section 308. Header 302 includes an inlet 312 for receiving refrigerant to the heat exchanger 300. Header 306 includes an outlet 314 for delivering refrigerant from the heat exchanger 300. When the HVAC system is in operation, section 308 receives refrigerant flow from header 302 and flows the refrigerant into header 304. The refrigerant then flows from header 304, through section 310, and into header 306.

As described above, the heat exchanger 300 acts as either a condenser or an evaporator to condense or vaporize the refrigerant, respectively. In either scenario, there is a large temperature differential between the refrigerant passing through header 302 and section 308 and the refrigerant passing through section 310 and header 306. The temperature differential can lead to a heat transfer between adjacent sections of tubes, resulting in a loss of efficiency and increased thermal stress on the joints between the tubes and the header. The above-mentioned temperature differential is much larger in the case of a condenser or gas cooler than in the case of an evaporator. In order to reduce this cross heat transfer, separations have been introduced between header 302 and header 306, and section 308 and section 310 to remove any direct contact between header 306 and header 306 and to remove any direct contact between section 308 and section 310. The separations are large enough to reduce, or even minimize, the cross heat transfer between adjacent sections because the heat transfer from each section is with the surrounding environment rather than between the adjacent sections of tubes.

As shown in FIG. 3, the separations may be a gap 316 between section 308 and section 310, and a gap 318 between header 302 and header 306. In other embodiments, there may be a gap 318 between section 308 and 310, and the headers 302, 306 may be connected, but spaced apart such that the portions of the headers 302, 306 that contain refrigerant are not in direct contact. In further embodiments, one or more of the gaps 316, 318 may be filled with a non-conductive material, such as a plastic, to provide structural support to the heat exchanger 300 or comprise the fins attached to one of the microchannel tubes either belonging to the section 308 or section 310, but not to the other. In the latter case, for instance, the non-conductive material can be used to prevent such bonding by brazing or mechanical interference contact. Alternatively, the clad material could be stripped from the referred tube surface (one side only) to prevent brazing. Other techniques may also be used.

Figure 5:
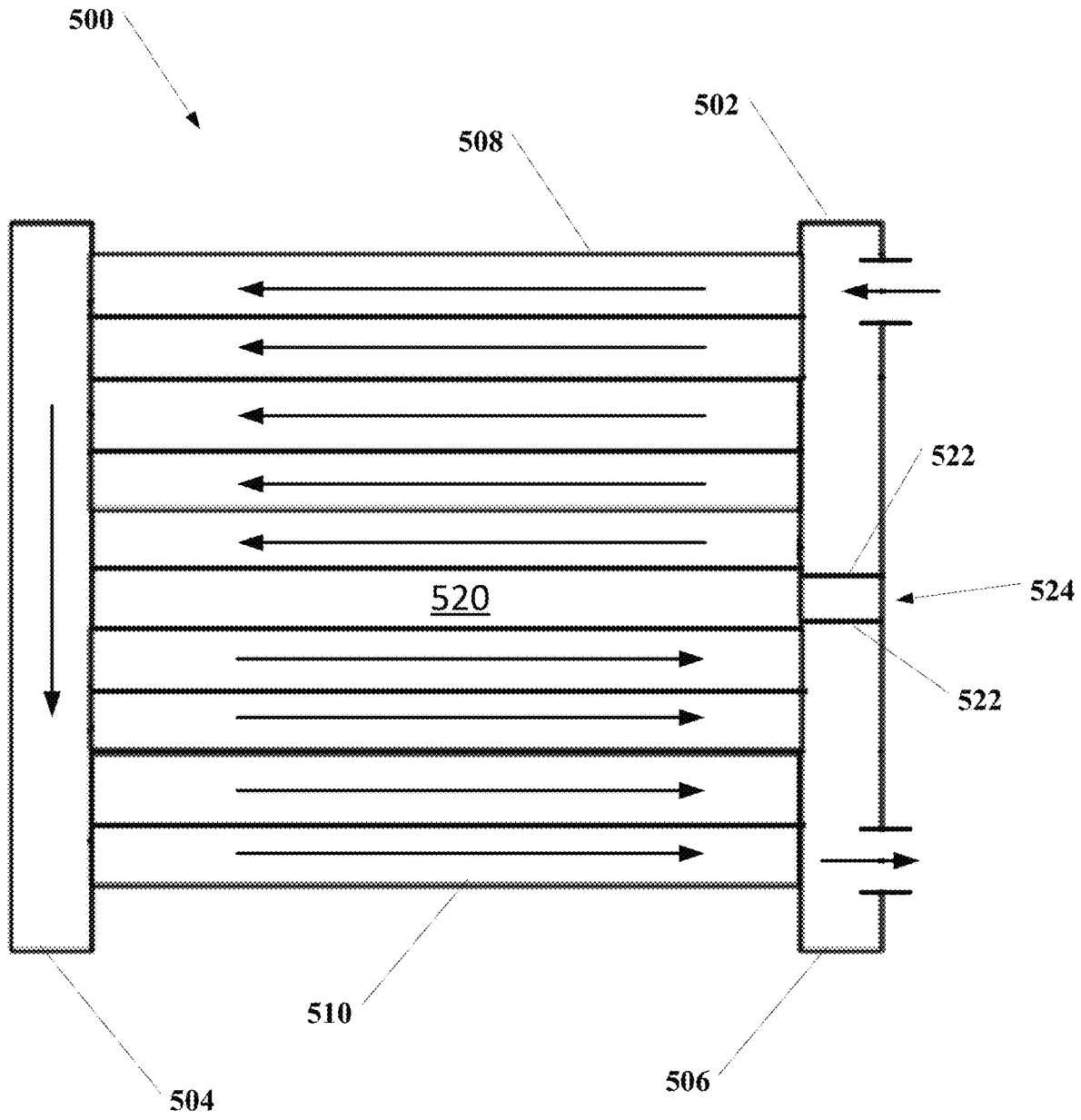
FIG. 5 is a block diagram of a heat exchanger, according to one or more embodiments.

Referring now to FIG. 5, FIG. 5 is a block diagram of a front view of a two-pass microchannel heat exchanger 500 that can be used in an HVAC system, as described above. Similar to the heat exchanger 300 described above with reference to FIG. 3, the heat exchanger 500 includes headers 502 and 504 that are in fluid communication via section 508. The heat exchanger further includes header 506 that is in fluid communication with header 504 via section 510.

The heat exchanger 500 further includes a section 520 of one or more "dead" microchannel tubes; i.e., a section of microchannel tubes that have no refrigerant passing therethrough. Section 502 separates section 508 from section 510 to reduce heat transfer while the HVAC system is in operation. In some embodiments, the fins extending between section 520 and sections 508 and 510 may also be cut longitudinally to further reduce heat transfer between section 508 and 510 via conduction across section 520. As shown in FIG. 5, header 302 and header 306 are separated by two separator plates 522, which form a chamber 524 between header 502 and header 506. The chamber separates the fluid flowing at different stages within the headers 502, 506 and also acts as an insulator, reducing heat transfer between the headers 502, 506. Further, the use of two separator plates reduces the possibility of leakage between the headers 502, 506, as both plates must develop a leak to have fluid transfer between the headers 502, 506. In other embodiments, headers 502, 506 may be separated by a gap, such as the gap 318 depicted in FIG. 3. In the latter case, the "dead" microchannel tube(s), if used, may be closed via crimping and/or brazed shut.

Although the embodiments illustrated in FIGS. 3 and 5 are two-pass microchannel heat exchangers, the invention is not thereby limited. The separation methods described above can be applied to heat exchangers having any number passes and sections. Further, a single heat exchanger may utilize gaps between sections, sections of one or more dead microchannel tubes between sections, or both gaps and sections of dead microchannel tubes. Similarly, a single heat exchanger may include gaps between headers, separation plates forming chambers between headers, or both gaps and chambers. As described above, the term gap refers to a physical gap or a gap preventing the cross-conduction path between the heat exchanger sections.

Figure 6A:
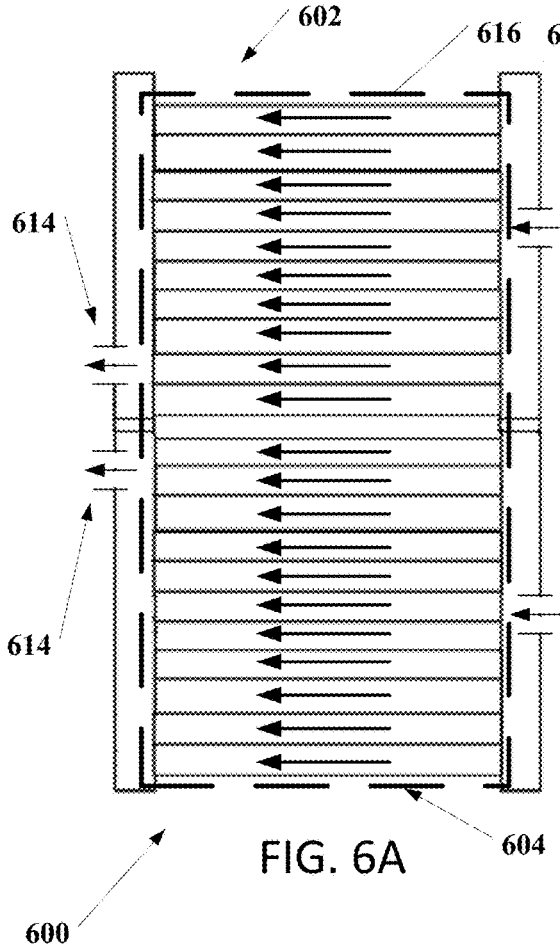
FIG. 6A is a front view of a microchannel heat exchanger, according to one or more embodiments.
Figure 6B:
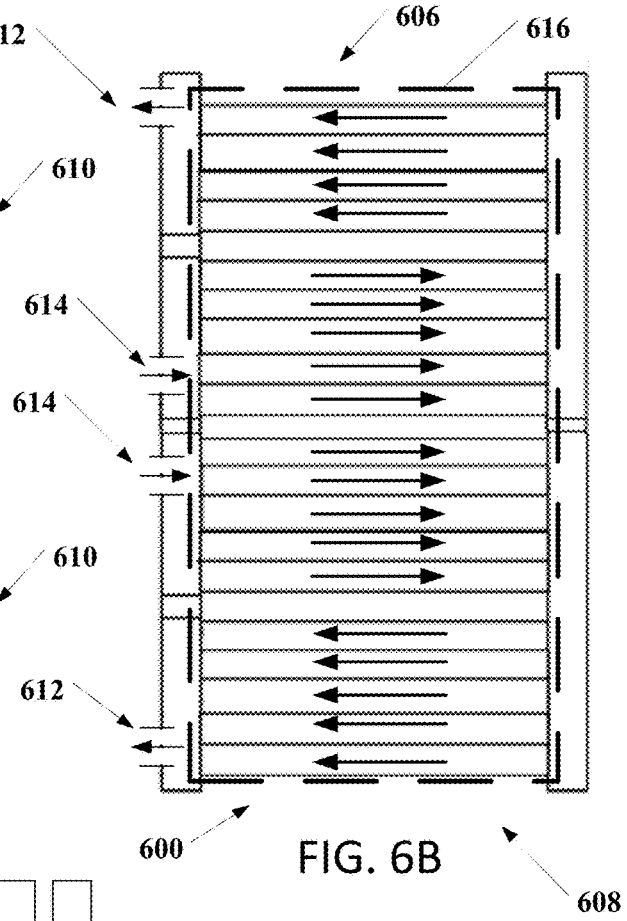
FIG. 6B is a back view of the microchannel heat exchanger of FIG. 6A.
Figure 6C:
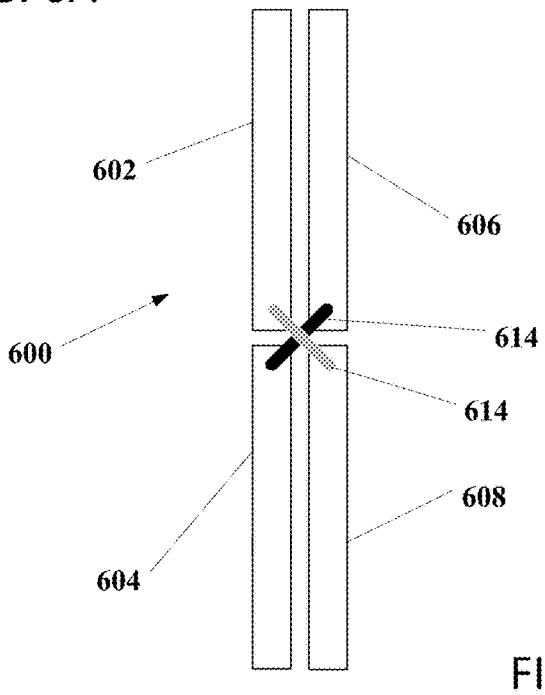
FIG. 6C is a side view of the microchannel heat exchanger of FIG. 6A.

Turning now to FIGS. 6A-6C, FIG. 6A-6C depict front, back, and side views of a microchannel heat exchanger 600, according to one or more embodiments. FIGS. 6A-6C include features that are similar to those described in relation to FIGS. 3-5. Accordingly, similar elements will not be described again in detail, except as necessary to describe the features of the heat exchanger 600. The heat exchanger 600 is arranged to be used with an HVAC system that has two refrigerant circuits that are each similar to the refrigerant circuit described above with reference to FIG. 2.

As shown most clearly in FIG. 6C, the heat exchanger 600 is made up of four heat exchanger sections 602, 604, 606, 608. The first upper heat exchanger section 602 and the first lower heat exchanger section 604 both include an inlet 610 that receives a first refrigerant and a second refrigerant, respectively. The refrigerants then flow through the respective heat exchanger sections 602, 604, 606, 608 and through the outlets 612.

The refrigerant passing through the first upper heat exchanger 602 then flows through a fluid coupling 614 and into the second lower heat exchanger. Similarly, the refrigerant passing through the first lower heat exchanger then flows through a fluid coupling 614 and into the second upper heat exchanger. The refrigerants then flow through the outlets 612 of the second upper heat exchanger and the second lower heat exchanger and continue through their respective circuits. This configuration of heat exchanger sections 602, 604, 606, 608 allows both the first refrigerant and the second refrigerant to flow through the majority of the face area or the entire face area of the heat exchangers, i.e., the surface area of the heat exchanger indicated by box 616, while remaining separate into two different circuits. This increases the efficiency of the heat exchanger 600 when the HVAC system is operating in a part load condition; i.e. only one of the refrigerant circuits is required to provide heating or cooling to the conditioned space, since the operational circuit can utilize a majority of the face area 616 or the entire face area 616 of the heat exchanger 600. This allows the operational circuit to transfer additional heat away from the refrigerant when compared to only utilizing a half or less of face area 616 the heat exchanger 600. Additionally, the crossing orientation of the circuits that is depicted in FIG. 6C increases efficiency of the heat exchanger 600 when both circuits are active.

As shown in FIG. 6C, the heat exchanger sections 602, 604, 606, 608 may be individual heat exchanger cells that are spaced apart, e.g., physically separated, from each other to decrease or minimize heat transfer between the cells. Additionally, the second upper heat exchanger section and the second lower heat exchanger may implement any of the spacing mechanisms described above with reference to FIGS. 3-5 to reduce heat transfer between passes. In other embodiments, the heat exchanger sections 602, 604, 606, 608 may be formed by installing internal baffles, similar to the baffles described above with reference to FIG. 5, within the headers of a single microchannel heat exchanger.

Although FIGS. 6A-6C depict a heat exchanger that is operable with two refrigerant circuits, the invention is not thereby limited. A heat exchanger may be expanded as necessary based on the principles herein to accommodate three, four, or more refrigerant circuits. Further, heat exchanger cells do not need to be a uniform size or arranged parallel to each other, FIGS. 6A-6C. In other embodiments, the heat exchanger cells may form an "X" pattern or a "V" pattern and/or one or more of the heat exchanger cells may be a different size than the other heat exchanger cells. The fin density and or the microchannel tube dimensions may also be varied between each cell based on the cooling and/or heating requirements of a particular HVAC system. Further, the two or more refrigerant circuits may use the same type of refrigerant (e.g., both refrigerants are R-32, R410A, R454B, or R-134a) or different types of refrigerants.

Figure 7A:
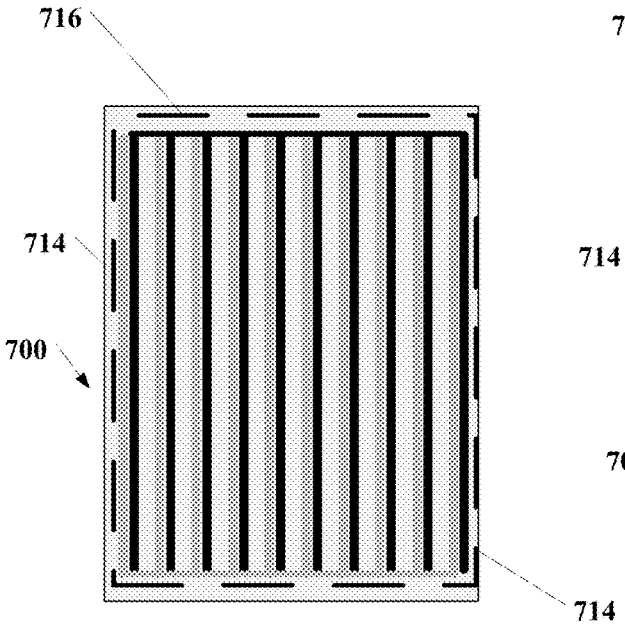
FIG. 7A is a front view of a heat exchanger, according to one or more embodiments.
Figure 7B:
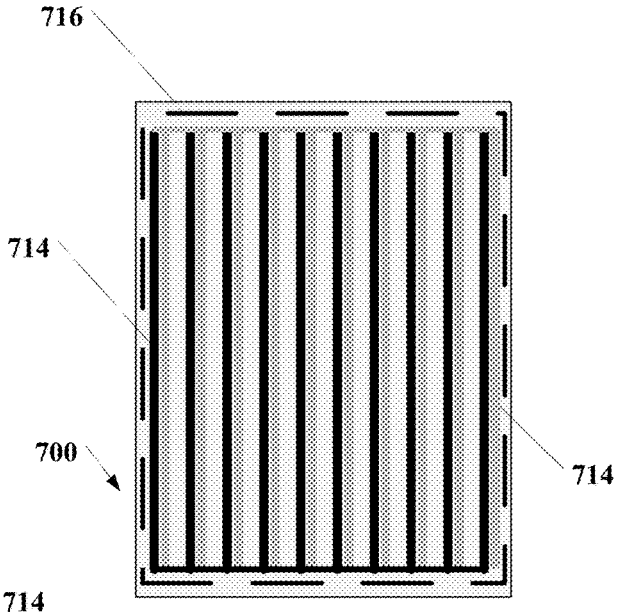
FIG. 7B is a back view of the heat exchanger of FIG. 7A.
Figure 7C:
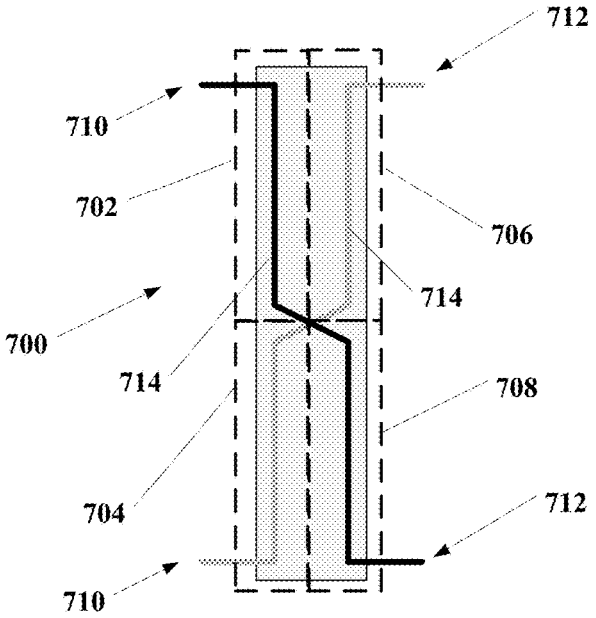
FIG. 7C is a side view of the heat exchanger of FIG. 7A.

Turning now to FIGS. 7A-7C, FIGS. 7A and 7B are front, back, and side views of a heat exchanger 700, according to one or more embodiments. The heat exchanger 700 depicted in FIGS. 7A-7C is a round tube, plate, and fin ("RTPF") heat exchanger. Similar to the heat exchanger described above with reference to FIGS. 6A-6C, the heat exchanger 700 is arranged to be used with an HVAC system that has two refrigerant circuits that are each similar the refrigerant circuits described above with reference to FIG. 2 and can be viewed as a first upper section 702, a first lower section 704, a second upper section 706, and a second lower section 708.

The first upper heat exchanger section 702 and the first lower heat exchanger section 704 both include an inlet 710 that receives a first refrigerant and a second refrigerant, respectively. The refrigerants are distributed between multiple tubes 714 that extend through the first upper section 702 and the second lower section 708, and the first lower section 704 and the second upper section 706, respectively, and are then consolidated to flow through the outlets 712. This configuration of heat exchanger sections 702, 704, 706, 708 allows both the first refrigerant and the second refrigerant to flow through a majority of the face area 716 or the entire face area 716 of the heat exchangers while remaining separate into two different circuits. This increases the efficiency of the heat exchanger 600 when the HVAC system is operating in a part load condition; i.e. only one of the refrigerant circuits is operational, since the operational circuit can utilize majority of the face area 716 or the entire face area 716 of the heat exchanger 700 and transfer additional heat away from the refrigerant when compared to only utilizing a portion of face area the heat exchanger 700.

Although the heat exchanger 700 depicted in FIGS. 7A and 7B includes a uniform number of tubes 714 on each circuit that extend through uniform sections 702, 704, 706, 708 of the heat exchanger 700, the invention is not thereby limited. The number and position of tubes 714 for each circuit may be varied as necessary to meet the heating and/or cooling requirements of the HVAC system. Further, the heat exchanger may enlarged and the spacing between tubes may be changed as necessary based on the principles herein to accommodate three, four, or more refrigerant circuits. Additionally, the tubes of one or more of the circuits may extend between more than two sections of the heat exchanger 700 (e.g., a tube may extend between the first upper section and second upper section before returning to the first upper section and then extending to the second lower section). Many of the variations discussed above with reference to FIGS. 6A-6C may also be implemented, as well as varying the tube dimensions, tube pattern, fin design, section size, and circuit length. The heat exchanger 700 may also be formed from separate slabs or the heat exchanger 700 may be a slit fin heat exchanger formed from a single slab.

Further examples include:

Example 1 is an HVAC system for use with a first refrigerant and a second refrigerant. The HVAC system includes a first refrigerant circuit for use with the first refrigerant, a second refrigerant circuit for use with the second refrigerant, and a heat exchanger operable as at least one of a condenser or a gas cooler. The first refrigerant circuit includes may include a first compressor, a first expansion device, and a first evaporator. The second refrigerant circuit includes a second compressor, a second expansion device, and a second evaporator. The compressor includes a first upper section, a first lower section, a second upper section in fluid communication with the first lower section, and a second lower section in fluid communication with the first upper section. The first upper section includes a first inlet to receive a first refrigerant from the first refrigerant circuit and the first lower section includes a second inlet to receive a second refrigerant from the second refrigerant circuit. The first upper section, the first lower section, the second upper section, and the second lower section are arranged such that the first refrigerant and the second refrigerant both flow through a majority of a face area of the heat exchanger while remaining in two different circuits.

Example 2 is the HVAC system of example 1 or any other appropriate example, wherein the heat exchanger is a microchannel heat exchanger.

Example 3 is the HVAC system of example 2 or any other appropriate example, wherein the first upper section, the first lower section, the second upper section, and the second lower section are heat exchanger cells.

Example 4 is the HVAC system of example 3 or any other appropriate example, wherein at least one of the first upper section, the first lower section, the second upper section, and the second lower section include a first header including an inlet for receiving refrigerant, a first section of microchannel tubes fluidly coupled to the first header for flowing the refrigerant through a first pass through the heat exchanger cell, a second header fluidly coupled to the first section, and a second section of microchannel tubes for flowing refrigerant through a second pass through the heat exchanger cell. The second section of microchannel tubes is fluidly coupled to the second header and separated from the first section of microchannel tubes enough to reduce heat transfer between the refrigerant flowing through the first pass and the refrigerant flowing through the second pass.

Example 5 is the HVAC system of example 2 or any other appropriate example, wherein the first upper section and the second upper section are spaced apart and the first lower section and the second lower section are spaced apart.

Example 6 is the HVAC system of example 2 or any other appropriate example, wherein the first upper section and the first lower section are spaced apart and the second upper section and the second lower section are spaced apart.

Example 7 is the HVAC system of example 2 or any other appropriate example, wherein the first upper section, the first lower section, the second upper section, and the second lower section are separated from each other via baffles positioned within headers of the heat exchanger.

Example 8 is the HVAC system of example 1 or any other appropriate example, wherein the heat exchanger is a RTPF heat exchanger.

Example 9 is the HVAC system of example 8 or any other appropriate example, wherein the heat exchanger further includes a first set of tubes fluidly coupled to the first inlet and extending though the first upper section and the second lower section and a second set of tubes fluidly coupled to the second inlet and extending though the first lower section and the second upper section.

Example 10 is the HVAC system of example 1 or any other appropriate example, wherein the first refrigerant and the second refrigerant are different types of refrigerant.

Example 11 is a heat exchanger for use with an HVAC system having a first refrigerant circuit and a second refrigerant circuit. The heat exchanger includes a first upper section, a first lower section, a second upper section in fluid communication with the first lower section, and a second lower section in fluid communication with the first upper section. The first upper section includes a first inlet to receive a first refrigerant from the first refrigerant circuit and the first lower section includes a second inlet to receive a second refrigerant from the second refrigerant circuit. The first upper section, the first lower section, the second upper section, and the second lower section are arranged such that the first refrigerant and the second refrigerant both flow through a majority of a face area of the heat exchanger while remaining in two different circuits.

Example 12 is the heat exchanger of example 11 or any other appropriate example, wherein the heat exchanger is a microchannel heat exchanger.

Example 13 is the heat exchanger of example 12 or any other appropriate example, wherein the first upper section, the first lower section, the second upper section, and the second lower section are heat exchanger cells.

Example 14 is the heat exchanger of example 13 or any other appropriate example, wherein at least one of the first upper section, the first lower section, the second upper section, and the second lower section include a first header including an inlet for receiving refrigerant, a first section of microchannel tubes fluidly coupled to the first header for flowing the refrigerant through a first pass through the heat exchanger cell, a second header fluidly coupled to the first section, and a second section of microchannel tubes for flowing refrigerant through a second pass through the heat exchanger cell. The second section of microchannel tubes is fluidly coupled to the second header and separated from the first section of microchannel tubes enough to reduce heat transfer between the refrigerant flowing through the first pass and the refrigerant flowing through the second pass.

Example 15 is the heat exchanger of example 12 or any other appropriate example, wherein at least two sections of the first upper section, the first lower section, second upper section, or the second lower section are spaced apart.

Example 16 is the heat exchanger of example 15 or any other appropriate example, wherein the at least two sections are spaced apart via a non-conductive material.

Example 17 is the heat exchanger of example 15 or any other appropriate example, wherein the at least two sections are spaced apart via dead microchannel tubes.

Example 18 is the heat exchanger of example 12 or any other appropriate example, wherein the first upper section, the first lower section, the second upper section, and the second lower section are separated from each other via baffles positioned within headers of the heat exchanger.

Example 19 is the heat exchanger of example 11 or any other appropriate example, wherein the heat exchanger is a RTPF heat exchanger.

Example 20 is the heat exchanger of example 19 or any other appropriate example, further including a first set of tubes fluidly coupled to the first inlet and extending though the first upper section and the second lower section and a second set of tubes fluidly coupled to the second inlet and extending though the first lower section and the second upper section.

Example 21 is the heat exchanger of example 19 or any other appropriate example, wherein the RTPF heat exchanger is a slit fin heat exchanger.

Example 22 is the heat exchanger of example 11 or any other appropriate example, wherein at least two of the first upper section, the first lower section, the second upper section and the second lower section are different sizes.

Certain terms are used throughout the description and claims to refer to particular features or components. As one skilled in the art will appreciate, different persons may refer to the same feature or component by different names. This document does not intend to distinguish between components or features that differ in name but not function. Further, terms such as upper, lower, front, and/or back are only used as general references within the individual components. The terms are not intended to imply any directionality within the overall HVAC system.

Reference throughout this specification to "one embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment. Reference to "includes" means, "includes, but is not limited to."

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A heating, ventilation, and air-conditioning ("HVAC") system for use with a first refrigerant and a second refrigerant, the HVAC system comprising:

a first refrigerant circuit for use with the first refrigerant and comprising a first compressor, a first expansion device, and a first evaporator;

a second refrigerant circuit separate from the first refrigerant circuit for use with the second refrigerant and comprising a second compressor, a second expansion device, and a second evaporator; and a microchannel heat exchanger operable as at least one of condenser or a gas cooler, the heat exchanger comprising:

a first upper section comprising a first inlet to receive the first refrigerant from the first refrigerant circuit;

a first lower section comprising a second inlet to receive the second refrigerant from the second refrigerant circuit;

a second upper section in fluid communication with the first lower section; and a second lower section in fluid communication with the first upper section;

wherein the first upper section, the first lower section, the second upper section, and the second lower section are arranged such that the first refrigerant and the second refrigerant both flow through a majority of a face area of the heat exchanger while remaining in the separate first and second circuits; and wherein at least one of the second upper section or the second lower section comprise a multi-pass heat exchanger comprising:

a first header at an end of the heat exchanger for flowing one of the first or second refrigerant; and a second header at the same end of the first header for flowing the same first or second refrigerant as the first header;

wherein the first and second headers are arranged with a first separation between the first and second headers such that portions of the first and second headers that contain the first or second refrigerant are not in direct contact.

2. The HVAC system of claim 1, wherein the first upper section, the first lower section, the second upper section, and the second lower section are heat exchanger cells.

3. The HVAC system of claim 2, wherein at least one of the second upper section or the second lower section further comprises:

a first section of microchannel tubes for flowing the first or second refrigerant from the first header through a first pass through the heat exchanger cell, the first section fluidly coupled to the first header;

a third header fluidly coupled to the first section at an opposing end of the heat exchanger; and a second section of microchannel tubes for flowing the same first or second refrigerant from the first section through a second pass through the heat exchanger cell, the second section of microchannel tubes fluidly coupled to between the third header and the second header;

wherein the first and second sections of microchannel tubes are arranged with a second separation directly between the first and second sections configured to reduce heat transfer between the refrigerant flowing through the first pass and the refrigerant flowing through the second pass.

4. The HVAC system of claim 1, wherein the first upper section and the second upper section are spaced apart and the first lower section and the second lower section are spaced apart.

5. The HVAC system of claim 1, wherein the first upper section and the first lower section are spaced apart and the second upper section and the second lower section are spaced apart.

6. A microchannel heat exchanger for a heating, ventilation, and air-conditioning ("HVAC") system having a first refrigerant circuit for use with a first refrigerant and a separate second refrigerant circuit for use with a second refrigerant, the heat exchanger comprising:

a first upper section comprising a first inlet to receive the first refrigerant from the first refrigerant circuit;

a first lower section comprising a second inlet to receive the second refrigerant from the second refrigerant circuit;

a second upper section in fluid communication with the first lower section; and a second lower section in fluid communication with the first upper section;

wherein the first upper section, the first lower section, the second upper section, and the second lower section are arranged such that the first refrigerant and the second refrigerant both flow through an entire face area of the heat exchanger while remaining in the separate first and second circuits; and wherein at least one of the second upper section or the second lower section comprise a multi-pass heat exchanger comprising:

a first header at an end of the heat exchanger for flowing one of the first or second refrigerant; and a second header at the same end of the first header for flowing the same first or second refrigerant as the first header;

wherein the first and second headers are arranged with a first separation between the first and second headers such that portions of the first and second headers that contain the first or second refrigerant are not in direct contact.

7. The microchannel heat exchanger of claim 6, wherein the first upper section, the first lower section, the second upper section, and the second lower section are heat exchanger cells.

8. The microchannel heat exchanger of claim 7, wherein at least one of the second upper section or the second lower section further comprises:

a first section of microchannel tubes for flowing the first or second refrigerant from the first header through a first pass through the heat exchanger cell, the first section fluidly coupled to the first header;

a third header fluidly coupled to the first section at an opposing end of the heat exchanger; and a second section of microchannel tubes for flowing the same first or second refrigerant from the first section through a second pass through the heat exchanger cell, the second section of microchannel tubes fluidly coupled between the third header and the second header;

wherein the first and second sections of microchannel tubes are arranged with a second separation directly between the first and second sections configured to reduce heat transfer between the refrigerant flowing through the first pass and the refrigerant flowing through the second pass.

9. The microchannel heat exchanger of claim 6, wherein at least two sections of the first upper section, the first lower section, second upper section, or the second lower section are spaced apart.

10. The microchannel heat exchanger of claim 6, wherein at least two of the first upper section, the first lower section, the second upper section and the second lower section are different sizes.

11. The microchannel heat exchanger of claim 6, wherein the first separation comprises at least one of a gap such that the first and second headers are not directly physically connected or a chamber formed between connected first and second headers.

12. The microchannel heat exchanger of claim 11, wherein the first separation comprises a gap filled with a non-conductive material.

13. The microchannel heat exchanger of claim 8, wherein the second separation comprises at least one of a gap or one or more sections of one or more dead microchannel tubes.

14. The microchannel heat exchanger of claim 13, wherein the separation comprises a gap filled with a non-conductive material.

15. The microchannel heat exchanger of claim 8, wherein the second refrigerant comprises a different refrigerant than the first refrigerant.

16. The HVAC system of claim 1, wherein the first separation comprises at least one of a gap such that the first and second headers are not directly physically connected or a chamber formed between connected first and second headers.

17. The HVAC system of claim 16, wherein the first separation comprises a gap filled with a non-conductive material.

18. The HVAC system of claim 3, wherein the second separation comprises at least one of a gap or one or more sections of one or more dead microchannel tubes.

19. The HVAC system of claim 18, wherein the separation comprises a gap filled with a non-conductive material.

20. The HVAC system of claim 1, wherein the second refrigerant comprises a different refrigerant than the first refrigerant.

* * * * *